US011549730B2

(12) United States Patent
Born et al.

(10) Patent No.: US 11,549,730 B2
(45) Date of Patent: Jan. 10, 2023

(54) REFRIGERATED FOOD CONTAINER

(71) Applicant: Emerson Climate Technologies, Inc., Sidney, OH (US)

(72) Inventors: Jason A. Born, Cincinnati, OH (US); Damiel Faxon, Temple, NH (US); Andrew Mangelsdorf, Cary, NC (US); Michael A. Saunders, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 307 days.

(21) Appl. No.: 16/778,819

(22) Filed: Jan. 31, 2020

(65) Prior Publication Data

US 2020/0248935 A1 Aug. 6, 2020

(51) Int. Cl.

| | |
|---|---|
| ***F25B 21/02*** | (2006.01) |
| ***F25D 17/04*** | (2006.01) |
| ***F25D 11/02*** | (2006.01) |

(52) U.S. Cl.

CPC ..... *F25B 21/02* (2013.01); *F25D 11/02* (2013.01); *F25D 17/04* (2013.01)

(58) Field of Classification Search

CPC ... F25B 21/02; F25B 2321/0212; F25D 11/00
See application file for complete search history.

(56) References Cited

U.S. PATENT DOCUMENTS

| | | | | |
|---|---|---|---|---|
| 5,718,124 | A * | 2/1998 | Senecal | A47F 3/0443 62/3.6 |
| 6,164,076 | A | 12/2000 | Chu et al. | |
| 6,295,820 | B1 | 10/2001 | Cauchy et al. | |
| 10,161,657 | B2 * | 12/2018 | Ilercil | F25D 11/003 |
| 2021/0387557 | A1 * | 12/2021 | Himmelreich | F25B 21/02 |

FOREIGN PATENT DOCUMENTS

| | | | |
|---|---|---|---|
| AU | 2014242042 | A1 | 8/2015 |
| AU | 2019200595 | A1 | 2/2019 |
| AU | 2019236611 | A1 | 10/2019 |
| CN | 1363025 | A | 8/2002 |
| CN | 103779288 | A | 5/2014 |
| CN | 105338865 | A | 2/2016 |
| DE | 4205881 | A1 | 9/1993 |

(Continued)

OTHER PUBLICATIONS

First Chinese Office Action & Chinese Search Report regarding Application No. 202010079027.X dated May 19, 2021. English translation provided by Unitalen Attorneys at Law.

(Continued)

*Primary Examiner* — Ana M Vazquezz

(57) ABSTRACT

A refrigerated food container system includes a container defining an inner volume and a thermoelectric module arranged in thermal contact with at least one surface of the container. The thermoelectric module includes a first thermoelectric cooling device and a second thermoelectric cooling device in thermal contact with the first thermoelectric cooling device. A control module is configured to provide a first voltage to the first thermoelectric cooling device and provide a second voltage to the second thermoelectric cooling device.

11 Claims, 6 Drawing Sheets

(56) References Cited

FOREIGN PATENT DOCUMENTS

| | | | | |
|---|---|---|---|---|
| DE | 102018008318 A1 * | 4/2020 | ..... | B60H 1/00478 |
| KR | 20010016399 A | 3/2001 | | |

OTHER PUBLICATIONS

Chinese Office Action regarding Application No. 202020151185.7 dated Sep. 1, 2020. English translation provided by Unitalen Attorneys at Law.

Notification of Grant of Patent for Utility Model received for Application No. 202020151185.7 dated Dec. 2, 2020 with English translation provided by Unitalen Attorneys at Law, 4 pages.

Second Chinese Office Action regarding Application No. 202010079027.X dated Oct. 22, 2021 with English translation provided by Unitalen Attorneys at Law, 8 pages.

Third Chinese Office Action regarding Application No. 202010079027.X dated Feb. 21, 2022 with English translation provided by Unitalen Attorneys at Law, 11 pages.

* cited by examiner

REFRIGERATED FOOD CONTAINER

CROSS-REFERENCE TO RELATED APPLICATIONS

This application claims the benefit of U.S. Provisional Application No. 62/800,006, filed on Feb. 1, 2019. The entire disclosure of the application referenced above is incorporated herein by reference.

FIELD

The present disclosure relates to refrigeration systems for portable storage containers.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Various types of food and beverages may require refrigeration to maintain quality. For home use, these items may be stored in a refrigerator. Some items, such as fruits and vegetables, may be stored in drawers inside the refrigerator. Accordingly, items stored inside the refrigerator may not be as readily visible and accessible as items stored outside of the refrigerator elsewhere in the home (e.g., in a pantry, on countertops, etc.).

SUMMARY

This section provides a general summary of the disclosure, and is not a comprehensive disclosure of its full scope or all of its features.

A refrigerated food container system includes a container defining an inner volume and a thermoelectric module arranged in thermal contact with at least one surface of the container. The thermoelectric module includes a first thermoelectric cooling device and a second thermoelectric cooling device in thermal contact with the first thermoelectric cooling device. A control module is configured to provide a first voltage to the first thermoelectric cooling device and provide a second voltage to the second thermoelectric cooling device.

In other features, the first thermoelectric cooling device is a first Peltier plate and the second thermoelectric cooling device is a second Peltier plate. The second Peltier plate is larger than the first Peltier plate. The first voltage is constant and the second voltage is adjustable. The control module includes a power supply configured to provide the first voltage to the first Peltier plate and a pulse width modulation controller configured to provide the second voltage to the second Peltier plate. The pulse width modulation controller is configured to adjust the second voltage provided to the second Peltier plate to a value greater than the first voltage provided to the first Peltier plate.

In other features, the refrigerated food container system includes a housing enclosing the container, wherein the housing defines a gap between the housing and the container. The refrigerated food container system includes a fan arranged to circulate air within the gap between the housing and the container. The fan is arranged to provide a flow of the air over the thermoelectric module and into the gap. The gap is arranged to provide a flow of the air across an upper opening of the container.

In other features, the container is bowl-shaped. A lower wall of the container is curved. Sidewalls of the container include one or more openings. The refrigerated food container system includes a rechargeable battery and the control module receives power from the rechargeable battery. The thermoelectric module is arranged between a lower surface of the container and a heat exchanger. The thermoelectric module is arranged against a sidewall of the container. A fan is arranged within the container.

A method of operating a refrigerated food container system including a container defining an inner volume includes arranging a thermoelectric module in thermal contact with at least one surface of the container. The thermoelectric module includes a first thermoelectric cooling device and a second thermoelectric cooling device in thermal contact with the first thermoelectric cooling device. The method includes providing a first voltage to the first thermoelectric cooling device and providing a second voltage different from the first voltage to the second thermoelectric cooling device.

In other features, providing the first voltage includes providing a constant voltage to the first thermoelectric cooling device and the method further includes adjusting the second voltage provided to the second thermoelectric cooling device. The method further includes adjusting the second voltage using pulse width modulation.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

It may be desirable for some food items that require refrigeration, such as fruits and vegetables, to be more readily visible and accessible than items stored in a refrigerator. Systems and methods according to the principles of the present disclosure provide a refrigeration system and container configured to maintain optimal storage conditions for food. The container is configured to maintain the food contained therein at a desired temperature while also maximizing visibility and accessibility. In some examples, the container may be portable and/or operate using power provided by a battery.

Figure 1B:
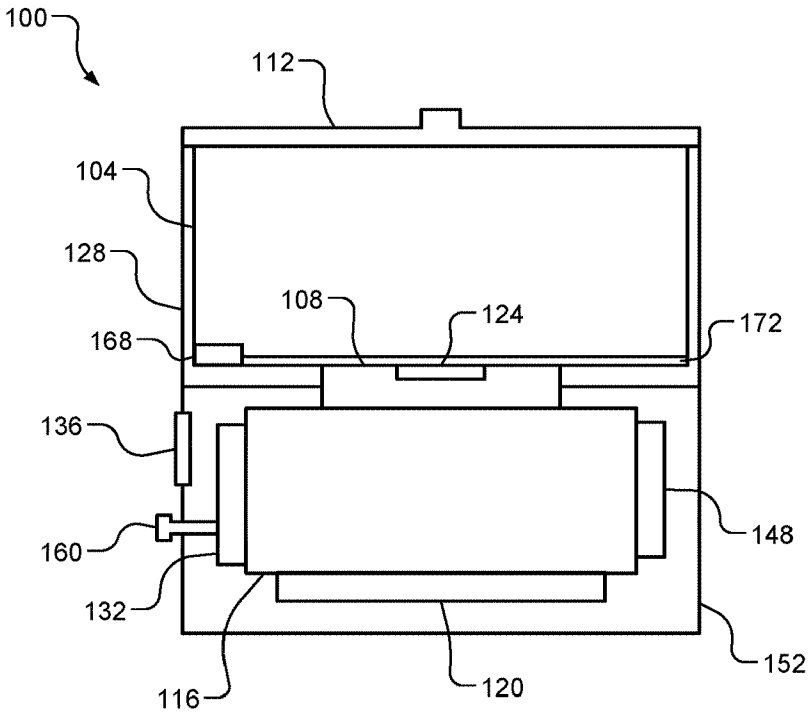
FIG. 1B is a schematic side view of an example refrigerated food container according to the present disclosure.
Figure 1A:
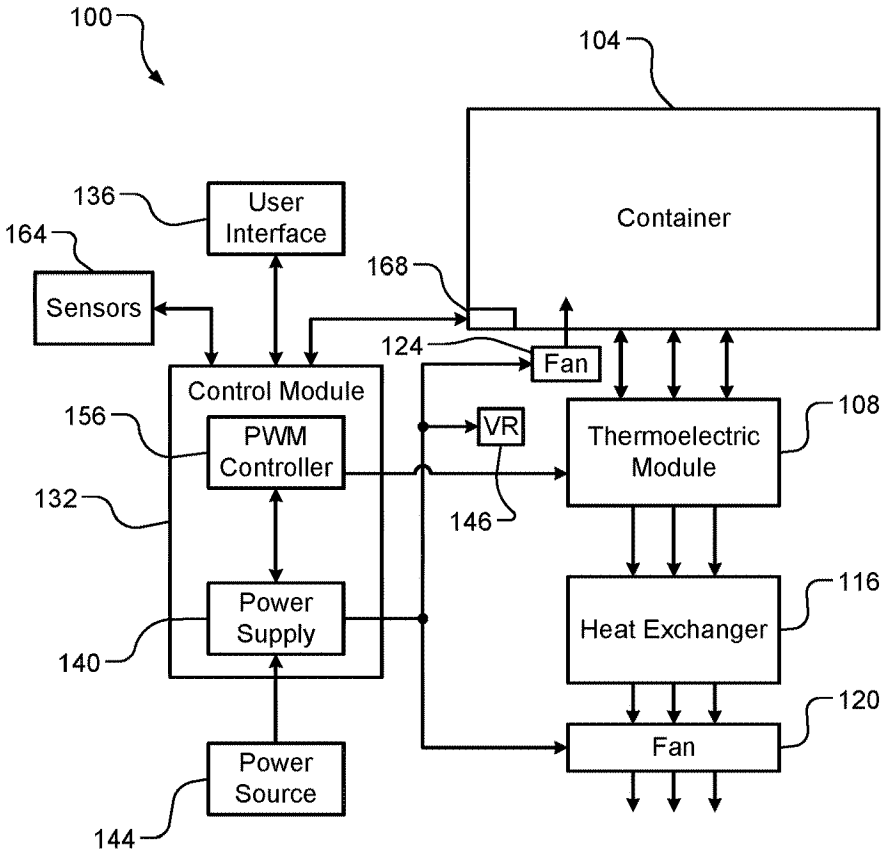
FIG. 1A is a functional block diagram of an example refrigerated food container system according to the present disclosure.

FIGS. 1A and 1B show a functional block diagram and schematic side view, respectively, of an example refrigerated food container system 100. The system 100 includes a container 104 and a thermoelectric module 108 arranged to cool (and/or, in some examples, heat) the container 104. The container 104 comprises a thermally-conductive metal such as copper, aluminum, etc. and defines an inner volume. The thermoelectric module 108 is arranged in thermal contact with and configured to provide thermoelectric cooling to the container 104. For example, the thermoelectric module 108 according to the present disclosure implements two or more thermoelectric cooling devices (e.g., Peltier devices, such as stacked or adjacent Peltier plates) each configured to provide cooling of the container 104 in response to an applied voltage as described below in more detail. In this manner, food or other items stored within the container 104 can be maintained at a desired temperature.

As shown, the thermoelectric module 108 is arranged between the container 104 and a heat exchanger 116. Current flowing through the thermoelectric module 108 in a first direction causes heat transfer from a container side of the thermoelectric module 108 to a heat exchanger side of the thermoelectric module 108 to cool the container 104. Current flowing through the thermoelectric module 108 in a second direction causes heat transfer from the heat exchanger 116 of the thermoelectric module 108 to the container side of the thermoelectric module 108 to heat the container 104. The heat exchanger 116 removes heat from the thermoelectric module 108 and a fan 120 exhausts warmed air from the system 100. In some examples, a fan 124 may be arranged to circulate cooled air within the container 104 (e.g., within an interior of the container 104 and/or in a gap between the container 104 and a housing (e.g., an upper housing) 128 enclosing the container 104).

A control module 132 controls operation of the system 100 including, but not limited to, supplying and adjusting power to the thermoelectric module 108, the fans 120 and 124, and/or an optional user interface 136 (e.g., a display, inputs, etc.). For example, the control module 132 includes a power supply 140 that supplies electrical power (e.g., a voltage) to the thermoelectric module 108 and the fans 120 and 124. The power supply 140 may convert a voltage received from a power source 144 (e.g., a wall outlet or receptacle configured to provide an AC or DC voltage) to a suitable lower voltage. For example, the power supply 140 may provide 5 volt power. A voltage regulator 146 may be provided between the power supply 140 and the thermoelectric module 108. In some examples, the system 100 may further include one or more rechargeable batteries 148 that provide power to the power supply 140. The control module 132, thermoelectric module 108, heat exchanger 116, fans 120 and 124, etc. may be enclosed within a housing (e.g., a lower housing) 152. In some examples, respective portions of some components (e.g., the thermoelectric module 108, the fan 124, etc.) may be enclosed within both housings 128 and 152.

The control module 132 may further include a pulse width modulation (PWM) controller 156 that provides an adjustable voltage to the thermoelectric module 108. For example, as described below in more detail, the thermoelectric module 108 may include two or more separately-controllable Peltier plates. The power supply 140 may provide a constant voltage to a first one of the Peltier plates while the PWM controller 156 provides the adjustable voltage (e.g., between 0 and 12 volts) to a second one of the Peltier plates. The adjustable voltage may be variable in accordance with user input via, for example only, the user interface 136, an input knob 160, etc.

As shown below in more detail in FIGS. 2A-2F, an upper one of the Peltier plates of the thermoelectric module 108 is in thermal contact with the container 104 and receives the constant voltage from the power supply 140 while a lower one of the Peltier plates is in thermal contact with the heat exchanger 116 and receives the adjustable voltage from the PWM controller 156. While receiving power, the Peltier plates insulate a cooled side (i.e., the container 104) from a warm side (i.e., the heat exchanger 116) of the system 100. Conversely, when neither of the Peltier plates is receiving power, the Peltier plates function as a conductor and conduct heat from the heat exchanger 116 into the container 104. Accordingly, the upper Peltier plate may be operated in an "always on" mode such that even when the adjustable voltage to the lower Peltier plate is turned off (e.g., set to 0 volts), the upper Peltier plate still receives at least a nominal voltage (e.g., 5 volts) to maintain insulation of the container 104 and prevent heat from the heat exchanger 116 from transferring back into the container 104.

In some examples, the control module 132 may be responsive to other user inputs, inputs from sensors, conditions such as a time of day and detected changes in temperature, etc. For example, the system 100 may include one or more sensors 164 arranged within or outside of the container 104 configured to sense ambient temperature, humidity (ambient humidity and/or humidity within the container 104), a weight of items within the container 104, ambient light, presence or absence of the lid 112, etc. The control module 132 may be configured to adjust power to the thermoelectric module 108 based on signals received from the sensors 164, detected conditions, and user settings. For example, user settings include, but are not limited to, a type of item stored within the container 104 (e.g., produce, vegetables, beverages, frozen foods, etc.).

Although shown in a manual lift-off configuration, in some examples the lid 112 may be hinged. In still other examples, the lid 112 may be configured to automatically open (e.g., responsive to the control module 132). For example, the lid 112 may be coupled to the housing 128 via motorized hinges. In some examples, one of the sensors 164 may correspond to a proximity sensor configured to detect the presence of a user and provide a signal to the control module 132 accordingly. In this example, the control module 132 may be configured to automatically open the lid 112 upon detection of a user.

In some examples, the control module 132 may be configured to monitor and track food amounts, consumption, etc. and provide nutrition data accordingly. For example, the control module 132 may determine an amount of food removed from the container 104 based on changes in weight (e.g., as calculate based on signals from one of the sensors 164 configured to sense a weight of items in the container 104) and calculate corresponding nutrition information (e.g., calories, protein, fiber, etc.) of the consumed food items. The calculation may be performed further based on data indicating a type of item stored in the container 104 (e.g., as input via the user interface 136). Users may track the nutrition information via the user interface 136, using an app executed on a smartphone or other mobile device, a website, etc. In some examples, the control module 132 may include a wireless communication interface configured to communicate relevant information to users, a cloud-based server, etc.

In some examples, the user may input a desired humidity within the container 104 and the control module 132 may adjust the humidity accordingly. For example, the system 100 may include a humidity control module 168 configured to generate and distribute mist within the container 104 responsive to the control module 132. For example only, the humidity control module 168 may include an exciter (e.g., an ultrasonic exciter) configured to selectively aerosolize water from a water reservoir 172 in a bottom of the container 104.

Referring now to FIGS. 2A-2F and with continued reference to FIGS. 1A and 1B, various examples of a thermoelectric module 200 according to the principles of the present disclosure are shown. In each example, the thermoelectric module 200 includes first and second thermoelectric cooling devices, such as upper and lower Peltier plates 204 and 208. A thermal paste layer (such as a thermal adhesive) 212 is provided between the Peltier plates 204 and 208, and additional thermal paste layers 212 may optionally be provided between the Peltier plate 204 and a lower surface of the container 104 and between the Peltier plate 208 and an upper surface of the heat exchanger 116. According, the Peltier plates 204 and 208 are in thermal contact with each other, the lower surface of the container 104, and the upper surface of the heat exchanger 116.

Each of the Peltier plates 204 and 208 receives power (e.g., voltage) from a respective one of the power supply 140 and the PWM controller 156. As shown in FIG. 2A, the upper Peltier plate 204 receives power (e.g., 5 volts) from the power supply 140 and the lower Peltier plate 208 receives power (e.g., 0-12 volts) from the PWM controller 156. In some examples, the upper Peltier plate 204 is operated in an "always on" configuration. In other words, the upper Peltier plate 204 may be powered (and provide cooling) whenever the system 100 is powered on to maintain a temperature of the container 104 at a desired setpoint. Conversely, the lower Peltier plate 208 may be variably powered (e.g., at between 0% and 100% of a maximum power).

For example, the thermoelectric module 200 may receive power to cool the container 104 in accordance with a setpoint temperature. The setpoint temperature may be set based on a user input (e.g., received via the user interface 136, the input knob 160, wirelessly via an app or other remote interface, etc.). Cooling provided by the upper Peltier plate 204 alone (i.e., with the lower Peltier plate 208 adjusted to 0%) may be sufficient to maintain the container at a first temperature range, such as between 33-60° F. Conversely, cooling provided by the upper Peltier plate 204 in combination with the lower Peltier plate 208 may achieve temperatures in a second temperature range below the first temperature range, such as between 10 and 32° F. as the lower Peltier plate 208 is adjusted (e.g., via user input and corresponding control of the PWM controller 156) between 0 and 100%.

In this manner, the thermoelectric module 200 may be configured to provide a desired amount of cooling based on user input, the items stored within the container 104, a desired power usage, etc. For example, it may be desirable to store some items at temperatures slightly below room temperature, other items at refrigerator temperature (e.g., between 33 and 40° F.), and still other items at freezing temperatures. In examples where the system 100 is powered by the battery 148, it may be desirable to increase the temperature (and decrease power usage) to increase remaining battery life. Accordingly, a corresponding remaining battery life (e.g., in minutes) may be displayed on the user interface 136 as the desired temperature is adjusted. In some examples, the control module 132 may be configured to automatically adjust the setpoint temperature as remaining battery life decreases.

Figure 2B:
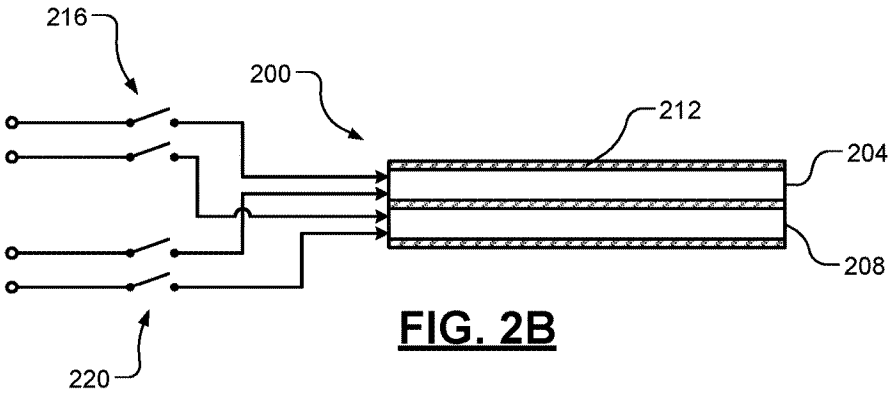
FIGS. 2A, 2B, 2C, 2D, 2E, and 2F illustrate example thermoelectric modules for a refrigerated food container according to the present disclosure.

As shown in FIG. 2B, each of the Peltier plates 204 and 208 may be selectively powered by either one of or both of the power supply 140 and the PWM controller 156. For example, one or more switches 216 may be provided between the power supply 140 and the Peltier plates 204 and 208 to allow power to be selectively provided from the power supply 140 to the Peltier plates 204 and 208. Conversely, one or more switches 220 may be provided between the PWM controller 156 and the Peltier plates 204 and 208 to allow power to be selectively provided from the PWM controller 156 to the Peltier plates 204 and 208.

Figure 2D:
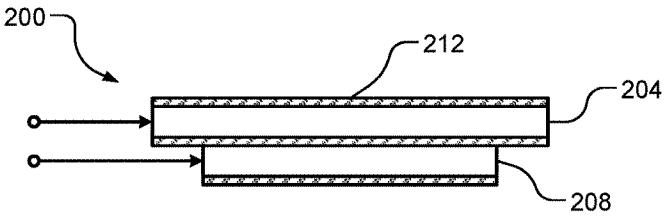
Figure 2F:
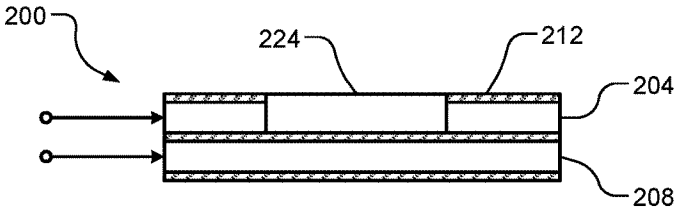
Figure 2A:
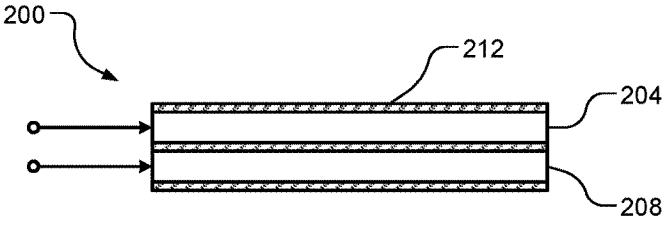
Figure 2C:
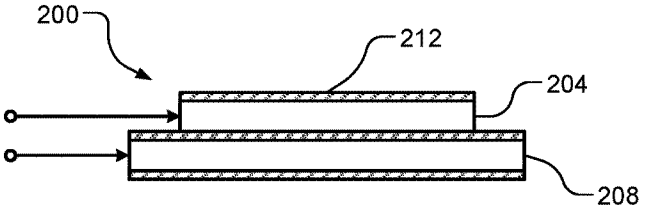
Figure 2E:
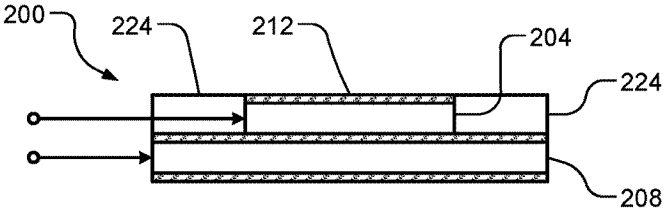

As shown in FIGS. 2A and 2B, the Peltier plates 204 and 208 are the same size. In other examples, such as shown in FIGS. 2C, 2D, and 2E, the Peltier plates 204 and 208 have different sizes. For example, as shown in FIGS. 2C and 2E, the Peltier plate 208 is larger than the Peltier plate 204. Conversely, as shown in FIG. 2D, the Peltier plate 204 is larger than the Peltier plate 208.

As shown in FIGS. 2E and 2F, the thermoelectric module 200 may include one or more fans 224 arranged to circulate air upward into the container 104. For example, as shown in FIG. 2E, the upper Peltier plate 204 may be smaller relative to the lower Peltier plate 208 to accommodate one or more of the fans 224 adjacent to the upper Peltier plate 204 on the upper surface of the lower Peltier plate 208. Conversely, as shown in FIG. 2F, the upper Peltier plate 208 may include an opening arranged to accommodate a centrally-located fan 224.

Figure 3B:
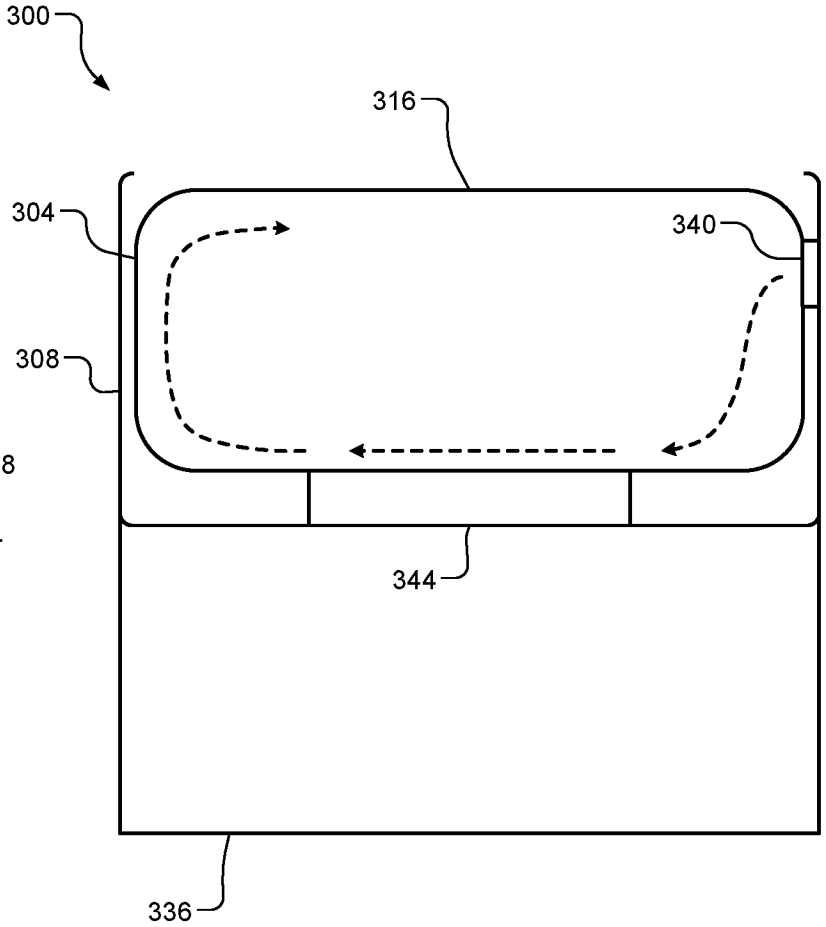
FIGS. 3A and 3B are schematic side views of example refrigerated food containers according to the present disclosure.
Figure 3A:
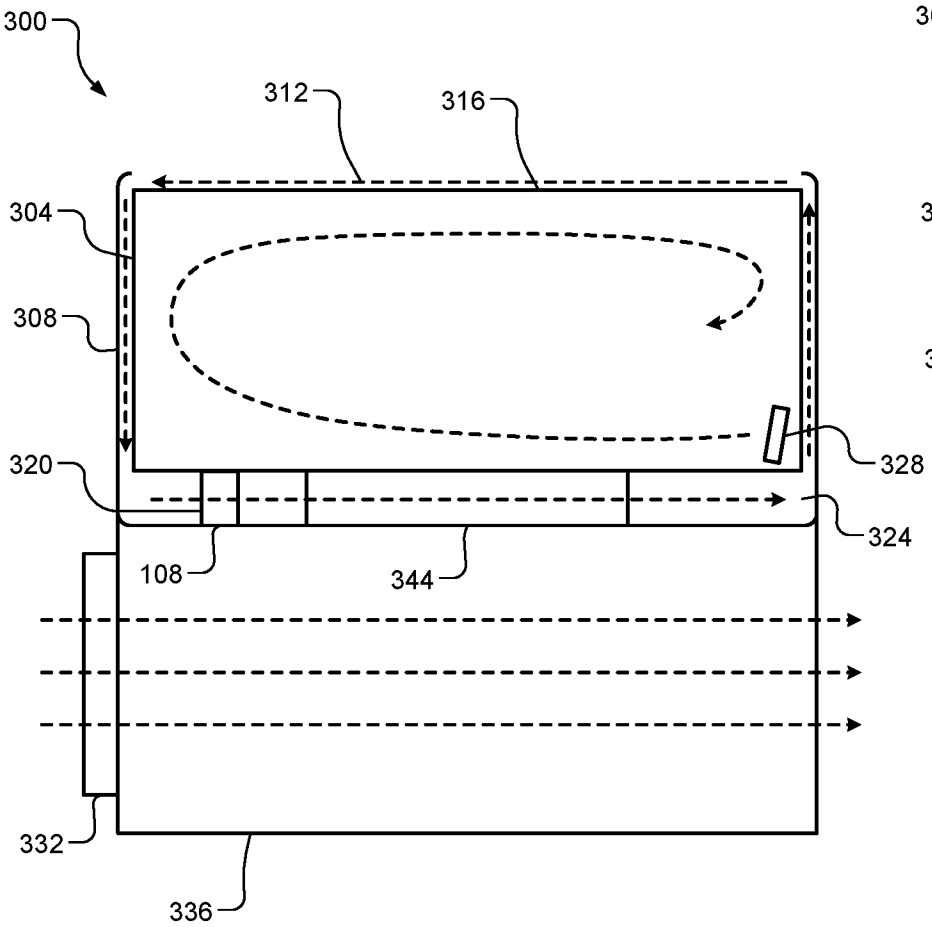

Other examples of a refrigerated food container system 300 according to the present disclosure are shown in FIGS. 3A and 3B. As shown in FIG. 3A, a container 304 and upper housing 308 are configured to provide an air curtain 312 across an upper opening 316 of the container 304. For example, the system 300 may include one or more fans 320 arranged to generate a circulating air flow in a gap 324 between the container 304 and the housing 308. Inner corners of the housing 308 may be rounded to facilitate the circulating air flow and provide the air curtain 312 flowing in a generally horizontal direction across the opening 316. The air curtain 312 prevents cooled air from escaping the container 304 and prevents ambient air from entering the container 304. In this manner, the system 300 may omit the lid 112 shown in FIG. 1B while maintaining a desired temperature within the container 304.

In some examples (e.g., in examples with or without the lid 112 and/or with or without the air curtain 312), one or more fans 328 may be arranged inside the container 304 to circulate the cooled air within the container 304. In still other examples, a fan 332 may be arranged on a side of a lower housing 336 to direct airflow through the lower housing 336 in a generally horizontal direction.

As shown in FIG. 3B, one or more Peltier plates 340 (e.g., in addition to a thermoelectric module 344 may be arranged asymmetrically relative to the container 304. In other words, the Peltier plate 340 is located near an upper side of the container 304. In this manner, cooled air provided by the Peltier plate 340 sinks downward within the container 304 and generates circular convection airflow. Corners of the container 304 may be rounded to facilitate circular airflow.

Figure 4B:
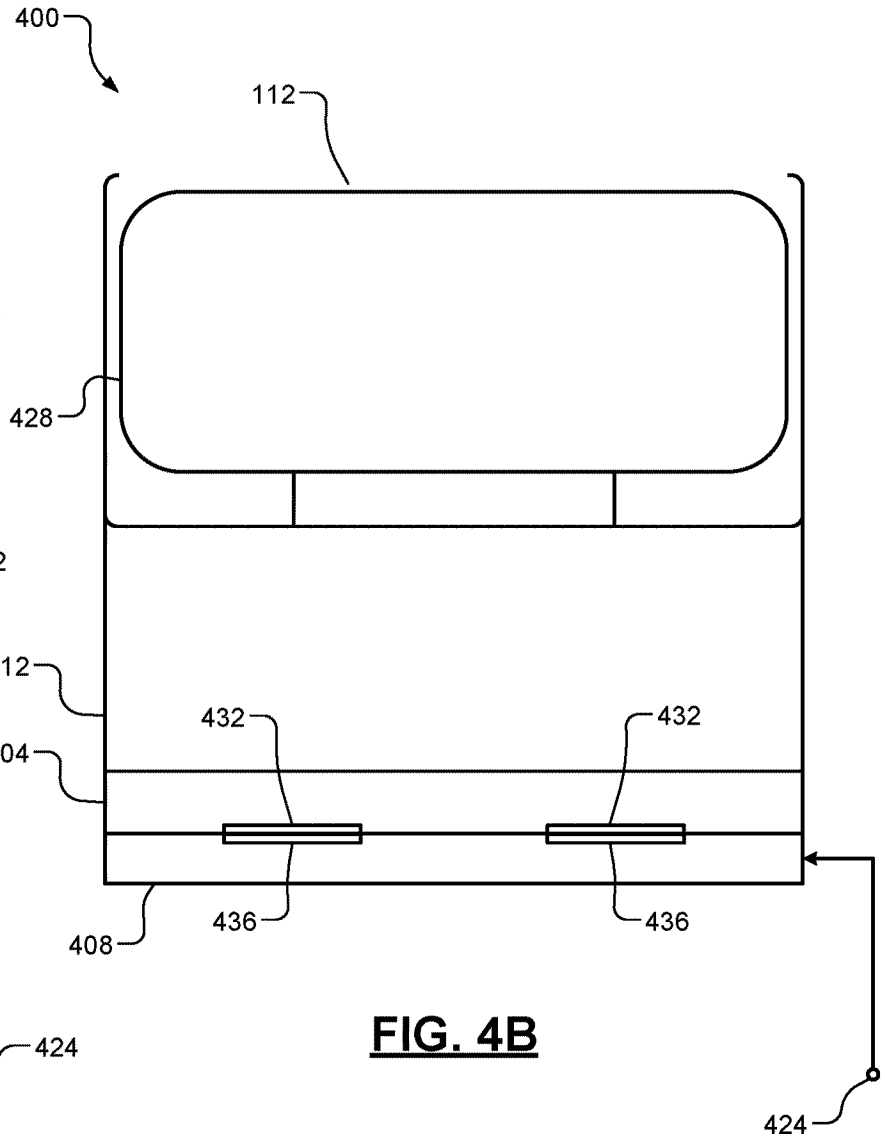
FIGS. 4A and 4B are schematic side views of example refrigerated food containers including a rechargeable battery according to the present disclosure.
Figure 4A:
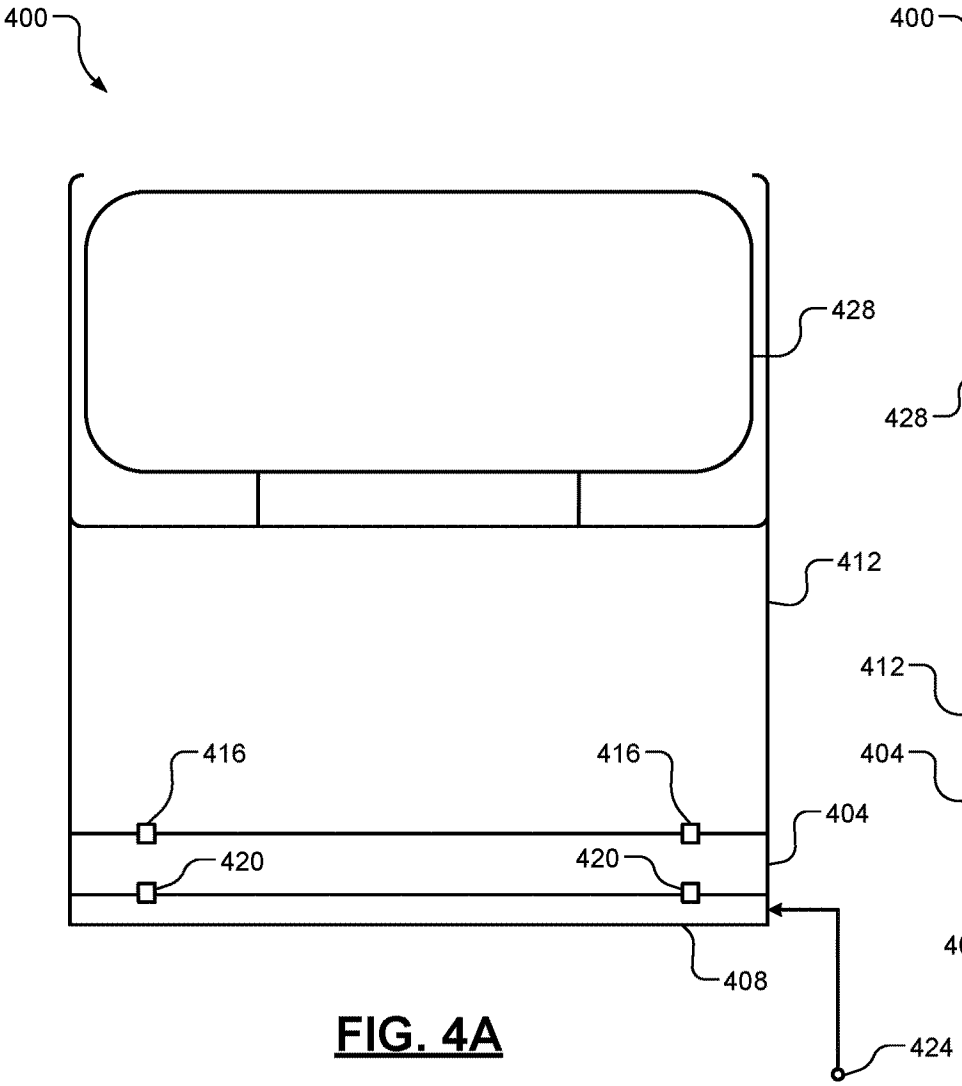

Examples of a refrigerated food container system 400 including a rechargeable battery 404 according to the present disclosure are shown in FIGS. 4A and 4B. As shown in FIG. 4A, the battery 404 is configured to be connected between a power supply 408 and a lower housing 412. For example, the battery 404 may include a first set of contact terminals 416 configured to mechanically and electrically connect to the lower housing 412 and a second set of contact terminals 420 configured to mechanically and electrically connect to the power supply 408. The power supply 408 receives power from a power source 424 (e.g., a wall outlet) to charge the battery 404. The system 400 including the battery 404 (when charged) may be selectively removed from the power supply 408. In this manner, the system 400 may maintain a desired temperature within container 428 for extended periods of time (e.g., during travel between locations, for outdoor or other activities where power is not available, etc.).

As shown in FIG. 4B, the battery 404 may be integrated within the lower housing 412 and include inductive charging coils 432. The inductive charging coils 432 are arranged to inductively communicate with inductive charging coils 436 on the power supply 408. In this manner, the system 400 provides wireless charging of the battery 404.

Figure 5:
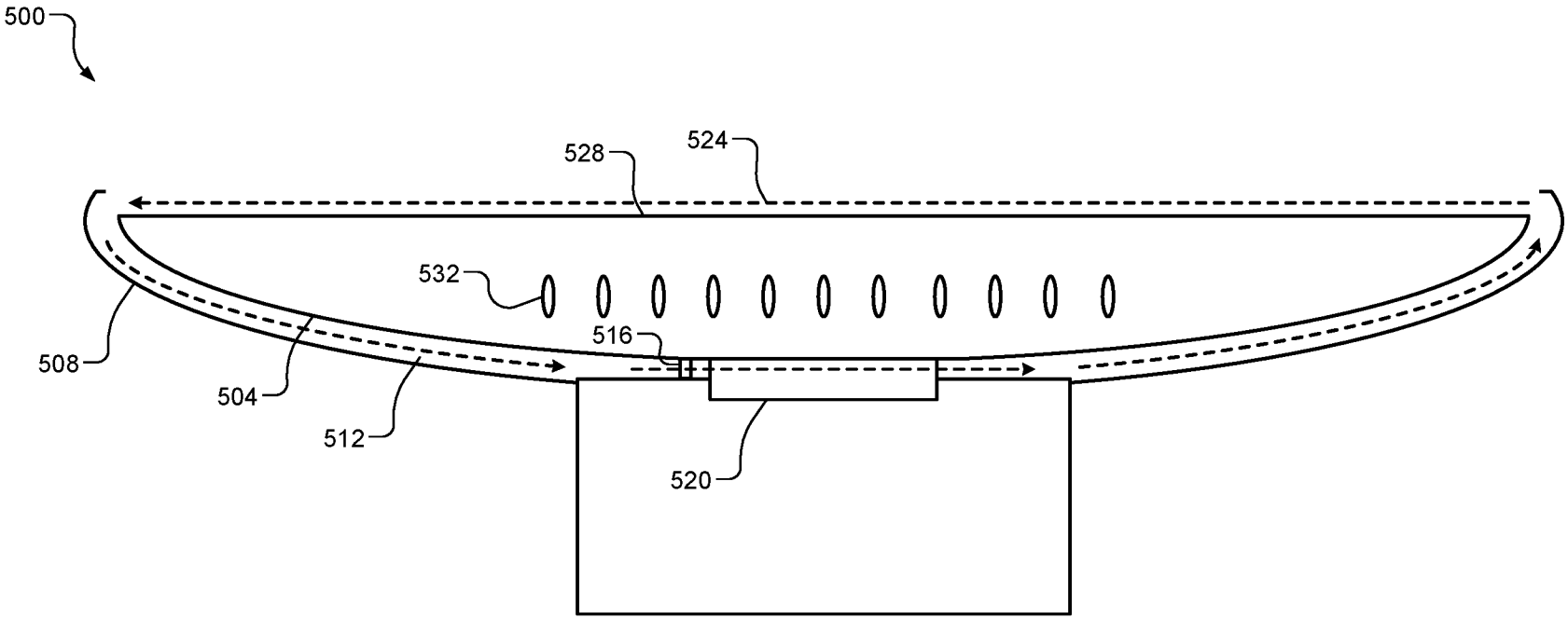
FIG. 5 is a schematic side view of another example refrigerated food container system according to the present disclosure.

Referring now to FIG. 5, another example refrigerated food container system 500 according to the present disclosure is shown. In this example, a container 504 and upper housing 508 are bowl-shaped. For example, lower walls of the container 504 and the housing 508 are curved. Accordingly, a gap 512 between the container 504 and the housing 508 is curved. In this manner, circulation of air by a fan 516 across a thermoelectric module 520 and around the container 504 and the generation of an air curtain 524 across an upper opening 528 of the container 504 are facilitated. In some examples, the sidewalls of the container 504 may include one or more openings 532 to facilitate the flow of cooled air into and within the container 504.

Figure 6:
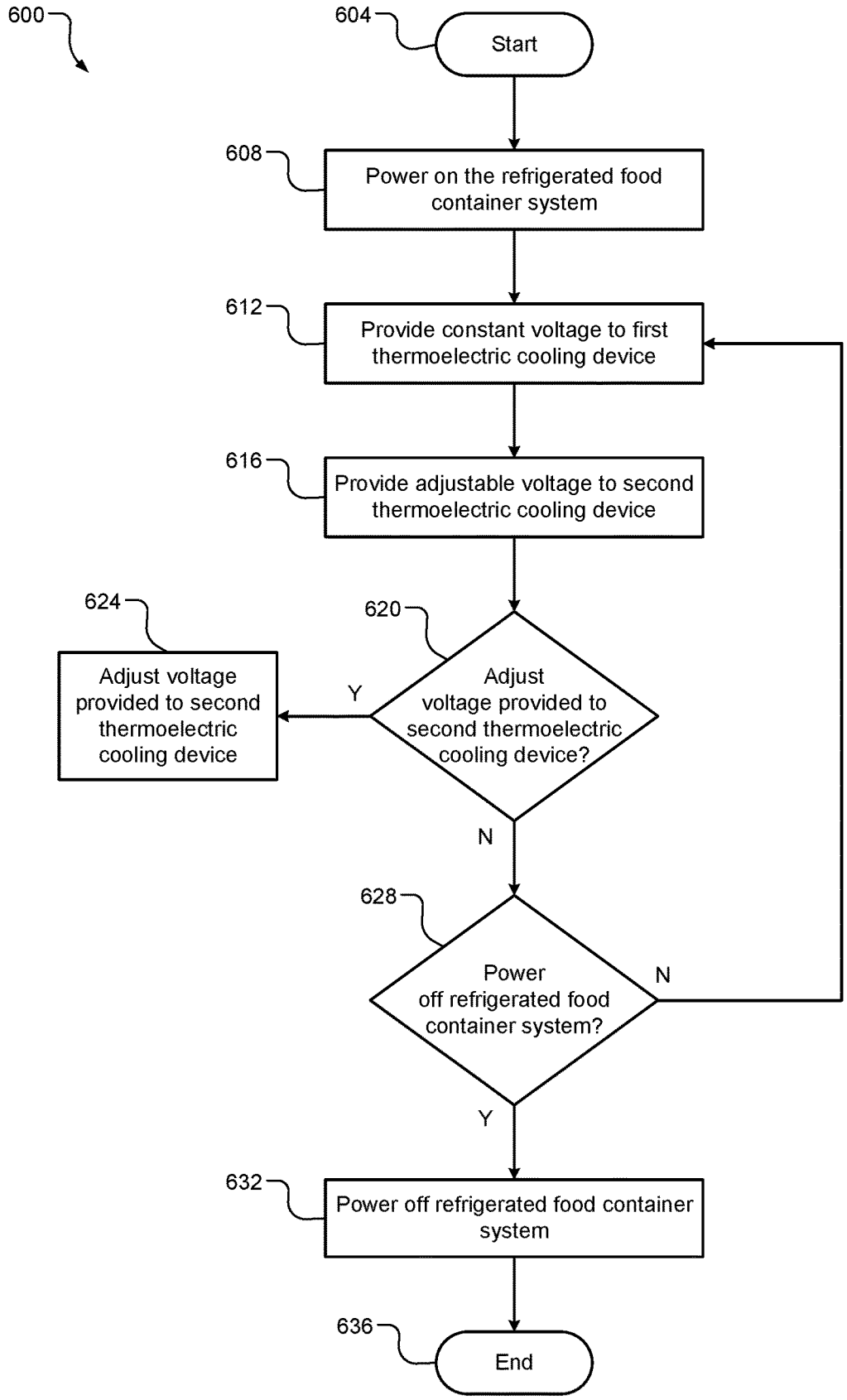
FIG. 6 illustrates steps of an example method of operating a refrigerated food container system according to the present disclosure.

Referring now to FIG. 6, an example method 600 of operating a refrigerated food container system according to the present disclosure begins at 604. For example, the refrigerated food container system corresponds to a system including container such as the container 104, 304, and 504 described above in FIGS. 1-5. At 608, the refrigerated food container system is powered on. At 612, the method 600 (e.g., via the power supply 140) provides a constant voltage to a first thermoelectric cooling device of a thermoelectric module in thermal contact with at least one surface of the container. At 616, the method 600 (e.g., the PWM controller 156) provides an adjustable voltage to a second thermoelectric cooling device of the thermoelectric module.

At 620, the method 600 (e.g., the control module 132) determines whether to adjust the adjustable voltage. For example, the method 600 determines whether to adjust the adjust voltage based on one or more inputs including, but not limited to, user inputs, inputs from sensors (e.g., temperature sensors), detected changes in ambient temperature and/or a temperature within the container, humidity, presence or absence of a lid, etc. If true, the method 600 continues to 624. If false, the method 600 continues to 628. At 624, the method 600 adjusts the adjustable voltage based on the one or more inputs.

At 628, the method 600 (e.g., the control module 132, responsive to user inputs) determines whether to power off the refrigerated food container system. If true, the method 600 powers off the refrigerated food container system at 632 and ends at 636. If false, the method 600 continues to 612.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), optical storage media (such as a CD, a DVD, or a Blu-ray Disc), and cloud computing storage.

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A refrigerated food container system, comprising:

a container defining an inner volume;

a thermoelectric module arranged in thermal contact with at least one surface of the container, wherein the thermoelectric module includes a first thermoelectric cooling device, and a second thermoelectric cooling device in thermal contact with the first thermoelectric cooling device; and a control module configured to provide a first voltage to the first thermoelectric cooling device and provide a second voltage to the second thermoelectric cooling device, wherein the first thermoelectric cooling device is a first Peltier plate and the second thermoelectric cooling device is a second Peltier plate, wherein the first voltage is constant and the second voltage is adjustable, wherein the control module includes a power supply configured to provide the first voltage to the first Peltier plate and a pulse width modulation controller configured to provide the second voltage to the second Peltier plate, and wherein the pulse width modulation controller is configured to adjust the second voltage provided to the second Peltier plate to a value greater than the first voltage provided to the first Peltier plate.

2. The refrigerated food container system of claim 1, wherein the second Peltier plate is larger than the first Peltier plate.

3. The refrigerated food container system of claim 1, further comprising a housing enclosing the container, wherein the housing defines a gap between the housing and the container, and wherein the housing and the gap are arranged to direct a flow of air to form an air curtain across an upper opening of the container, and a fan arranged to circulate air within the gap between the housing and the container.

4. The refrigerated food container system of claim 3, wherein the fan is arranged to provide a flow of the air over the thermoelectric module and into the gap.

5. The refrigerated food container system of claim 1, wherein the container is bowl-shaped.

6. The refrigerated food container system of claim 1, wherein a lower wall of the container is curved.

7. The refrigerated food container system of claim 1, wherein sidewalls of the container include one or more openings.

8. The refrigerated food container system of claim 1, further comprising a rechargeable battery, wherein the control module receives power from the rechargeable battery.

9. The refrigerated food container system of claim 1, wherein the thermoelectric module is arranged between a lower surface of the container and a heat exchanger.

10. The refrigerated food container system of claim 1, wherein the thermoelectric module is arranged against a sidewall of the container.

11. The refrigerated food container system of claim 1, further comprising a fan arranged within the container.

* * * * *